US005425891A

United States Patent [19]

Pujol et al.

[11] Patent Number: 5,425,891

[45] Date of Patent: Jun. 20, 1995

[54] DETERGENT COMPOSITION CONTAINING AN ANTIFOAMING MIXTURE OF A SOAP AND A GLYCERINE OXIDE ADDUCT

[75] Inventors: Enrique Pujol; Francisco Pujadas; Antoni Prat; Kazuhiko Okabe, all of Barcelona, Spain

[73] Assignee: Kao Corporation, Barcelona, Spain

[21] Appl. No.: 230,013

[22] Filed: Apr. 19, 1994

Related U.S. Application Data

[63] Continuation of Ser. No. 979,047, Nov. 19, 1992, abandoned.

[30] Foreign Application Priority Data

Jul. 20, 1992 [EP] European Pat. Off. ..... 92500093

[51] Int. Cl.[6] ..... C11D 1/72; C11D 1/831; C11D 10/04; C11D 17/06

[52] U.S. Cl. ..... 252/132; 252/109; 252/121; 252/174; 252/174.21; 252/321; 252/358; 252/559; 252/DIG. 1

[58] Field of Search ..... 252/132, 121, 109, 134, 252/174, 174.21, 321, 358, 559

[56] References Cited

U.S. PATENT DOCUMENTS

| | | | |
|---|---|---|---|
| 2,923,686 | 2/1960 | Ohlmann | 252/74 |
| 2,954,347 | 9/1960 | St. John | 252/109 |
| 2,954,348 | 9/1960 | Schwoeppe | 252/109 |
| 3,826,749 | 7/1974 | Demangeon | 252/121 |
| 4,071,468 | 1/1978 | Abel | 252/321 |
| 4,247,425 | 1/1981 | Egan et al. | 252/174.22 |
| 4,256,611 | 3/1981 | Egan et al. | 252/174.22 |
| 4,259,217 | 3/1981 | Murphy | 252/174.22 |
| 4,306,987 | 12/1981 | Kaneko | 252/174.22 |
| 4,321,157 | 3/1982 | Harris et al. | 252/174.22 |
| 4,428,749 | 1/1984 | Morris | 252/174 |
| 4,902,439 | 2/1990 | Abel et al. | 252/164 |
| 4,908,150 | 3/1990 | Hessel et al. | 252/174.12 |
| 4,963,284 | 10/1990 | Novakovic | 252/108 |
| 4,978,471 | 12/1990 | Starch | 252/174.22 |
| 5,142,020 | 8/1992 | Kud et al. | 252/174.22 |
| 5,262,154 | 11/1993 | Wendel | 424/73 |

FOREIGN PATENT DOCUMENTS

| | | |
|---|---|---|
| 0080749 | 6/1983 | European Pat. Off. . |
| 3943070 | 7/1991 | Germany . |
| 52-22007 | 2/1977 | Japan . |
| 52-22009 | 2/1977 | Japan . |
| 55-86894 | 7/1980 | Japan . |
| 55-133495 | 10/1980 | Japan . |
| 56-118498 | 9/1981 | Japan . |
| 63-245500 | 10/1988 | Japan . |
| 01040598 | 2/1989 | Japan . |
| 01158099 | 6/1989 | Japan . |

OTHER PUBLICATIONS

Chemical Abstracts, vol. 100, No. 24 (1984) Abstract No. 194041r Jun.

*Primary Examiner*—Dennis Albrecht

*Attorney, Agent, or Firm*—Birch, Stewart, Kolasch & Birch

[57] ABSTRACT

The detergent composition comprises ethoxylated glycerine, compound represented by the formula (I) and fatty acid alkaline metal salt, represented by the formula (II); the weight ratio of the former to the latter [(I)/(II)], being essentially 10/90–90/10, preferably 1/5 to 5/1, and most preferably 1/3 to 3/1.

(I)

wherein:

R′ represents H or $CH_3$, and each of n, m and l independently represents an integer from 0 to 20; being m+n+l=2–60 preferably 10–45.

R—COOM (II)

wherein R represents alkyl or alkenyl group having $C_{7-21}$, and M represents an alkaline metal.

The combination of compounds (I) and (II) permits a saving in the amount of antifoaming agents, as well as shows a better performance in skin irritation, oral toxicity and biodegradation, without deteriorating its detergency.

12 Claims, 1 Drawing Sheet

DETERGENT COMPOSITION CONTAINING AN ANTIFOAMING MIXTURE OF A SOAP AND A GLYCERINE OXIDE ADDUCT

This application is a continuation of application Ser. No. 07/979,047, filed on Nov. 19, 1992, now abandoned.

FIELD OF THE INVENTION

The present invention relates to novel detergent compositions that are biodegradable, non-toxic and non-irritating while maintaining and even improving its detergency.

DESCRIPTION OF PRIOR BACKGROUND ART

One of the current problems, not only in the sphere of various detergents, but also in the whole field of chemicals, is the question of ecotoxicity.

The nonionics employed in the detergent compositions were conventionally ethoxylated nonylphenols, $C_{14-18}$ alcohols ethoxylated with approximately 12 moles of ethylene oxides, and lately $C_{12-15}$ alcohols ethoxylated with 7 to 9 moles of ethylene oxides.

For instance,

Japanese Patent Laid-Open No. 55-86894, discloses the use of secondary $C_{6-14}$ alcohols ethoxylated with 4–15 moles of ethylene oxides on average.

Japanese Patent Laid-Open No. 52-22009 and Japanese patent Publication N. 83-37356, discloses the use of an ethoxylated middle alcohol ethoxylated of formula $R_1O(C_2H_4O)nH$, wherein $R_1$ stands for straight chain or branched alkyl radicals and n is 1–12 on average in detergent compositions.

European Patent No. 80749, discloses the use of ethoxylated alkyl phenols in detergent compositions.

These conventional nonionics were, however, unsatisfactory with respect to the rinsing properties, that is, antifoaming effect.

U.S. Pat. No. 4,908,150, discloses the use of polyethylene glycol ether of a glycerol ester composition.

Japanese Patent Laid-Open No. 55-133495, discloses the use of a polyoxyethylene hardened castor oil or fatty acid ester thereof, polyethylene glyceryl ether fatty acid ester, polyoxyethylene trimethylol propane fatty acid ester and polyoxyethylne alkylether diester of N-lauroylglutamic acid, in detergent compositions.

However, use of such nonionics deteriorates the detergency ability of detergent formulation.

SUMMARY OF THE INVENTION

Accordingly, it is an object of the present invention to provide a detergent composition possessing satisfactory antifoaming properties while mantaining and even improving its detergency.

The basis of the present invention is the finding that the replacement of conventional nonionics with a combination of ethoxylated glycerine (I) and fatty acid alkali metal salt (II) (weight ratio, (I)/(II)=10/90 to 90/10) surprisingly results in the improvement of antifoaming properties and biodegradability of the detergent formulations without degrading its detergency.

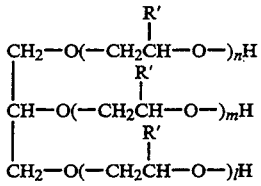

(I)

wherein

"n", "m" and "l" are each numbers from 0 to 20, and $(n+m+l)=2-60$.

R′ represents H or $CH_3$. and $$R—COOM \quad (II)$$

wherein R represents alkyl or alkenyl group having $C_{7-21}$, and M represents an alkali metal.

DETAILED DESCRIPTION OF THE INVENTION AND PREFERRED EMBODIMENTS

Figure 1:
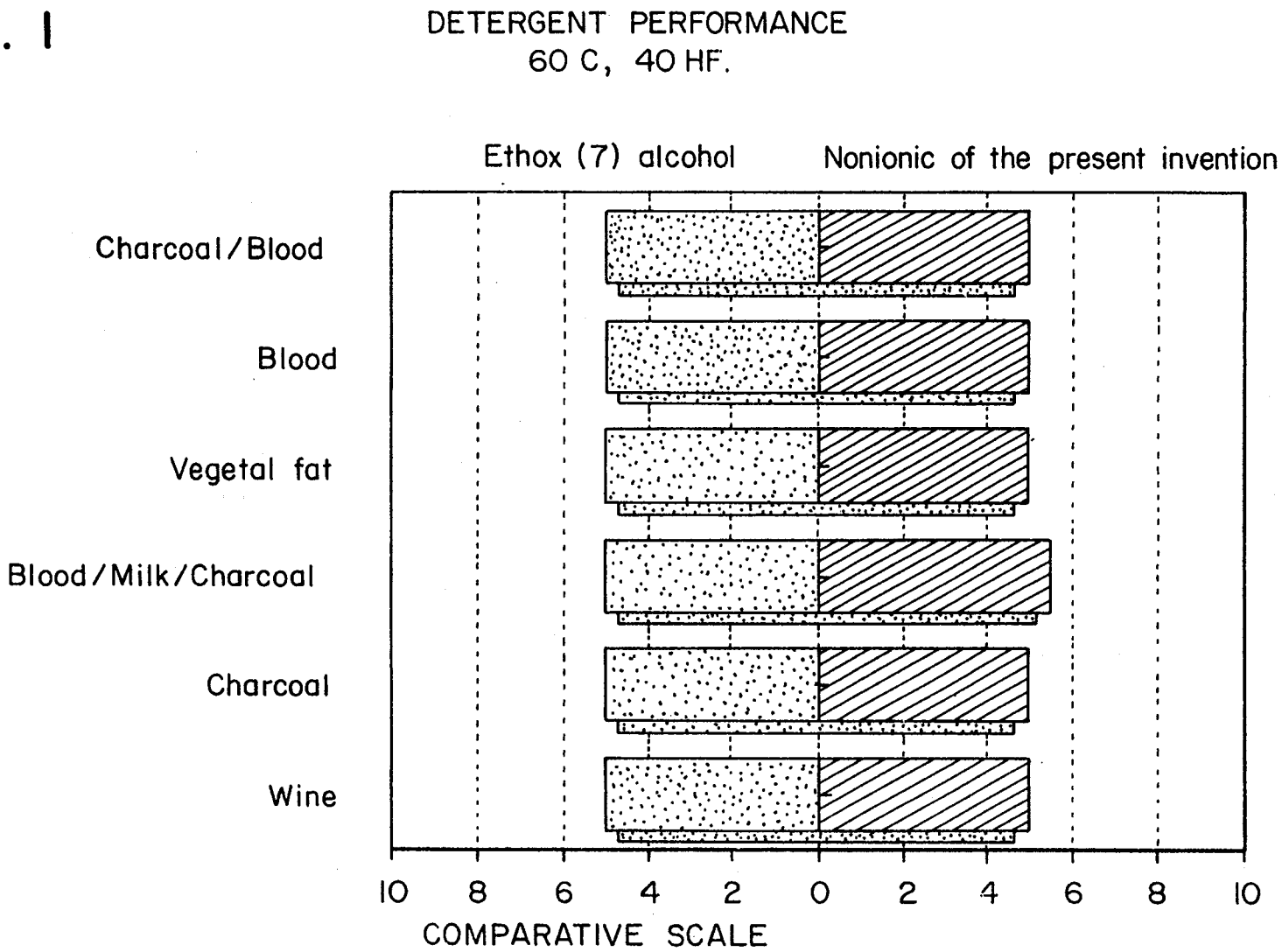
FIG. 1 shows a comparison of the detergent performance of the nonionic of the present invention and that of an ethoxy (7) alcohol at 60° C. and 40° HF water hardness.

The present invention will now be described in detail with reference to its examples.

The inventors have directed their efforts toward obtaining an improved fabric detergent composition having satisfactory antifoaming properties while maintaining its detergency and have found that replacement of the conventional nonionics by a combination of ethoxylated glycerine (I) and fatty acid alkali metal salt (II) (weight ratio, (I)/(II)=10/90 to 90/10 preferably 1/5 to 5/1 most preferably 1/3 to 3/1) satisfies such requirements,

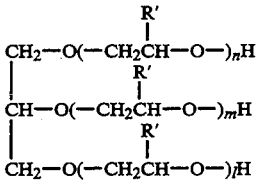

(I)

wherein

"n", "m", "l" are each numbers from 0 to 20, $(n+m+l)=2-60$, preferably 10–45.

R′ represents H or $CH_3$. and $$R—COOM \quad (II)$$

wherein R represents alkyl or alkenyl group having $C_{7-21}$ and M represents an alkali metal.

Ethoxylated glycerine (I) can be prepared according to conventional methods, for example, by the reaction of glycerine and ethylene oxide in the presence of alkaline catalyst such as KOH or NaOH.

Fatty acid alkali salt (II) of the present invention includes sodium or potasium salt of caproic acid, lauric acid, palmitic acid, stearic acid, fatty acid derived coconut oil or tallow oil or the mixed acids thereof.

The combination of ethoxylated glycerine and fatty acid alkali salt can also be obtained by hydrolyzing ethoxylated triglyceride.

In the present invention, the weight ratio (I)/(II) is critical, essentially 10/90 to 90/10, preferably from 1/5 to 5/1, most preferably from 1/3 to 3/1. Thus the use of the combination of ethoxylated glycerine (I) and fatty acid alkali salt (II) outside the range described above fails to bring about the desired results.

The detergent composition of the present invention can be prepared, for example, by means of the following processed.

A. Process which comprises adding fatty acid sodium salt and ethoxylated glycerine compounds represented by formulae (I) and (II) to the detergent slurry and spraying the slurry mixture into dryer to make powder detergent.

B. Process which comprises adding mixture of fatty acid alkali salt and ethoxylated glycerine compounds represented by formulae (I) and (II) to the powder detergent mixture and mixing the mixture obtained.

In the present invention, the compound of formulae (I) and (II) can be incorporated in an amount of from 0.5 to 40%, preferably from 3 to 20%, by weight based on the whole of the detergent composition.

The reason why the present invention exhibits the outstanding biodegradable, non-toxic and non-irritanty performance without deterioration of its detergency is uncertain, but it seems to applicant that the good performance of the present composition comes partially from the fact that the fatty acid groups and glycerine structure facilities high biodegradability and very low skin irritation and oral toxicity in the present invention compared with conventional nonionics.

Furthermore, the incorporation of compound (I) and (II) considerably improves the antifoaming properties of the detergent composition when compared with conventional formulations, which permits a saving in the amount of antifoaming agents (foam controllers) of up to 75%, depending on the formulations.

In preparing the present invention, various components other than the compounds of formulae (I) and (II) can be incorporated unless the component impedes the performance of the invention.

Components that can be incorporated are illustrated below:

i) Surface active agents:

anionics such as: alkyl $C_{10-24}$ benzene sulfonates, alkane $C_{10-24}$ sulfonates, alkyl $C_{10-24}$ ether sulfates with 1–30 moles of ethylene and/or propylene oxide, etc. Detergent composition comprise from 0 to 30% of anionic.

conventional nonionics such as nonionics produced by the reaction of aliphatic alcohols, fatty acids, fatty amides or alkyl phenols, with alkylene oxides, especially ethylene oxide, which may be used alone or together with propylene oxide.

Nonionics can be used in an amount of 0–25% by weight of detergent composition.

Examples of normal nonionics may be: ethoxylated nonylphenol, ethoxylated (un)branched alcohol.

amine compounds such as: imidazolines having fatty acid ester group and/or tertiary amine having at least one $C_{8-22}$ alkyl or alkenyl group.

ii) Antifoaming agents (foam controllers): silicone (polysiloxane)

iii) Chelating agent Zeolite, citric acid salt, ethylenediamine tetracetate, nitrilotriacetate, layered silicate, tripolyphosphate, etc.

iv) Alkali agent Sodium carbonate, potassium carbonate, sodium silicate, alkanol amine, etc.

v) Filler Sodium sulfate, etc.

vi) Enzyme Amilase, protease, cellulose, lipase, etc.

vii) Dispersing Agent Acrylic acid polymer, maleic acid polymer, polyethylene glycol, carboxymethyl cellulose, etc.

viii) Bleaching Agent Sodium percarbonate, sodium perborate, etc.

ix) Other Fluorescent dye, perfume, colorant, preservative, etc.

| | | (preferred) |
|---|---|---|
| Compound (I) | 2–40 wt % | (3–20) |
| Anionic surfactant | 0–30 wt % | (3–20) |
| Antifoaming agent | 0–10 wt % | (0.05–0.5) |
| Chelating agent | 10–50 wt % | (15–40) |
| Alkali agent | 0–50 wt % | (3–25) |
| Filler + other additives | 0–50 wt % | (13–35) |
| Enzyme | 0–2 wt % | (0.1–1) |
| Dispersing agent | 0–5 wt % | (1–4) |
| Bleaching agent | 0–25 wt % | (5–20) |

EXAMPLE

The present invention is described in detail by way of the following examples. The present invention, however is not limited to these examples.

EXAMPLES

Ethoxylated glycerine is obtained, for instance by means of one of the following process:

REFERENTIAL EXAMPLE 1

Preparation of ethoxylated glycerine (I-1)

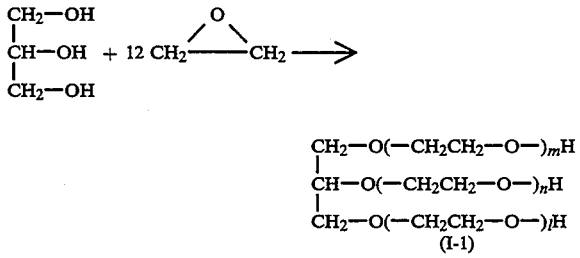

(I-1)

wherein: $l+m+n=12$.

200 g (2.17 moles) of glycerine 99% and 4.2 g of KOH 85% as catalyst are placed in a 2 kg flask properly equipped. The system is purged several times with $N_2$, vacuum striped till 110° C., and further heated to 140° C. When the temperature reaches 140° C. the reactor is pressurized to 2–3 kg/cm$^2$ and ethylene oxide is added until a total of 1147,82 g (12 moles).

After the final charge of ethylene oxide, the reaction mixture is allowed to react for about ½ hour. Finally the product is cooled and discharged from reactor.

REFERENTIAL EXAMPLE 2

Preparation of ethoxylated glycerine (I-2).

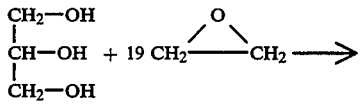

-continued

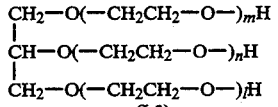

(I-2)

wherein: 1+m+n=19.

200.0 g (2.17 moles) of glycerine 99% and 4.2 g of KOH 85% as catalyst are placed in a 3 kg flask properly equipped. The system is purged several times with $N_2$, vacuum stripped till 110° C., and further heated to 140° C. When the temperature reaches 140° C. the reactor is pressurized to 2–3 kg/cm$^2$ and ethylene oxide is added until a total of 1814.12 g (19 moles).

After the final charge of ethylene oxide, the reaction mixture is allowed to react for about ½ hour. Finally the product is cooled and discharged from the reactor.

REFERENTIAL EXAMPLE 3

Preparation of ethoxylated glycerine (I-3).

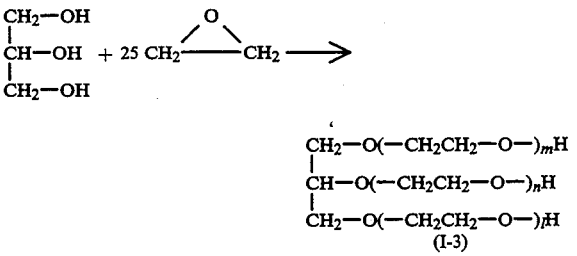

(I-3)

wherein: 1+m+n=25.

200.0 g (2.17 moles) of glycerine 99% and 4.2 g of KOH 85% as catalyst are placed in a 4 kg flask properly equipped. The system is purged several times with $N_2$, vacuum stripped till 110° C., and further heated to 140° C. When the temperature reaches 140° C. the reactor is pressurized to 2–3 kg/cm$^2$ and ethylene oxide is added until a total of 2387 g (25 moles).

After the final charge of ethylene oxide, the reaction mixture is allowed to react for about ½ hour. Finally the product is cooled and discharged from the reactor.

Detergency test conditions:

Apparatus: Launder-o-meter.

Water hardness: 20° HF and 40° HF.

Steel balls: 30.

Detergent concentration: 5 g/l.

Number of EMPA: 5.

Washing cycle, Temperature: 60° C./30° C. Time: 30 min.

RINSE Temperature: Room temperature. Time: 10 min. No. of times: 3 $H_2O$ hardness: 20° and 40° HF. Volume: 100 ml.

EMPA TYPE indicated in each case.

Reflective (light) coefficients of an original cloth before being artificially soiled, a soiled cloth before washing and a soiled cloth after washing were measured by self-recording colorimeter.

Detergency was evaluated by means of detergency coefficient calculated from the following formula.

-continued $$\text{Detergency coefficient \%} = \frac{\text{Reflective Coefficient After Washing} - \text{Reflective Coefficient Before Washing}}{\text{Reflective Coefficient Of Original Cloth} - \text{Reflective Coefficient Before Washing}} \times 100$$

EXAMPLE 1

Detergent compositions containing a fatty acid sodium salt, and ethoxylated glycerine and its properties are illustrated in the following examples:

| Component | wt % |
|---|---|
| Sodium dodecylbenzene sulphonate | 8.50 |
| Soap | 5.00 |
| Ethoxylated glycerine (obtained in referential example 1.) | 2.50 |
| STPP | 46.00 |
| Sodium silicate | 23.00 |
| Sodium sulfate | balance |
| CMC | 1.00 |
| Enzyme | 0.45 |
| Fluorescent agent | 0.15 |

The results of detergency on EMPAS (*) 101, 102, 103 and 104 show in all cases a similar performance to a current non-ionic.

On different types of natural dirt, such as coal/blood, blood, vegetable fat, blood/coal/milk, coal and wine shows a good performance. (see FIG. 1)

(*) Test fabrics represents EMPA in this hemisphere for standard soil fabrics. EMPA is the Swiss Federal Testing Station in Switzerland.

EMPA 101 Cotton soil test cloth (oily soil).

EMPA 102 Wool soil test cloth (oily soil).

EMPA 103 Cotton soil test cloth (red wine).

EMPA 104 Polyester/Cotton soil test cloth (oily soil).

EXAMPLE 2

| Component | wt % |
|---|---|
| Sodium dodecylbenzene sulphonate | 10.00 |
| Soap | 4.00 |
| Ethoxylated glycerine (obtained in referential example 3.) | 4.00 |
| STPP | 40.00 |
| Sodium silicate | 5.00 |
| Sodium sulfate | balance |
| CMC | 1.00 |
| Enzyme | 0.45 |
| Fluorescent agent | 0.15 |

As regards detergency the results on EMPAS 101 and 104 do not exhibit statistically significant differences between the nonionics and the combination presented in this invention, at usual detergent conditions. However using water hardness of 40°–60° HF, detergent performance of combination of (I) and (II) shows an increase of 10% in detergency ability.

EXAMPLE 3

| Component | wt % |
|---|---|
| Sodium dodecylbenzene sulphonate | 9.00 |
| Soap | 2.00 |
| Ethoxylated glycerine (obtained in referential example 2.) | 3.00 |
| Zeolite | 35.00 |

-continued

| Component | wt % |
|---|---|
| Acrylic-maleic copolymer | 3.00 |
| Sodium silicate | 3.00 |
| Sodium sulfate | balance |
| Sodium carbonate | 9.00 |
| Enzyme | 0.45 |
| Fluorescent agent | 0.15 |

Detergency on EMPAS 101 and 104 at low water hardness (20° HF) does not exhibit statistically significant differences. However using water hardness of 40°–60° HF, and low temperatures (20°–30° C.), detergent performance of combination presented in this invention shows an increasing of 7–10% in detergent ability.

EXAMPLE 4

| Component | wt % |
|---|---|
| Sodium dodecylbenzene sulphonate | 6.00 |
| Soap | 4.00 |
| Ethoxylated glycerine (obtained in referential example 2) | 3.00 |
| STPP | 30.00 |
| Sodium silicate | 7.00 |
| Sodium sulfate | balance |
| Fluorescent agent | 0.15 |
| Enzyme | 0.45 |

As regards detergent performance the results on EMPAS 101 and 104, the combination presented in this invention exhibits a better performance, that is, an increase of 6% (average) in detergent ability.

We claim:

1. A powder detergent composition comprising at least about 0.5 percent by weight of an anionic surfactant and about 0.5 percent to about 40 percent by weight of an antifoaming mixture of a glycerine compound having formula (I)

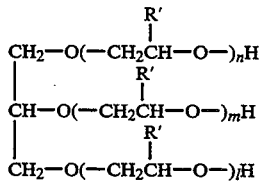

(I)

wherein R′ is H or $CH_3$, and each of n, m and l independently is an integer from 0 to 20 and the sum of m, n and l is from 2–60; and a fatty acid alkali metal salt having formula (II)

R—COOM (II)

wherein R is an alkyl or alkenyl group having 7–21 carbon atoms, and M is an alkali metal, wherein the weight ratio of said ethoxylated glycerine to said fatty acid alkali metal salt is from 1:5–5:1.

2. The powder detergent composition according to claim 1, wherein the weight ratio of said ethoxylated glycerine to said fatty acid alkali metal salt is from 1:3–3:1.

3. The powder detergent composition according to claim 1, wherein the sum of m, n and l is from 10–45.

4. The powder detergent composition according to claim 1, wherein the sum of m, n and l is from 25–35.

5. The powder detergent composition according to claim 1, wherein the weight ratio of said ethoxylated glycerine to said fatty acid alkali metal salt is from 37:53–53:37.

6. The powder detergent composition according to claim 1, wherein the fatty acid alkali metal salt is derived from the group consisting of miristic acid, oleic acid, linoleic acid, caprilic acid, palmitoleic acid, lauroleic acid and mixtures thereof.

7. The powder detergent composition according to claim 1, wherein the fatty acid alkali metal salt is selected from the group consisting of a sodium salt of caproic acid, lauric acid, palmitic acid, stearic acid, or fatty acid derived coconut oil or tallow oil, and potassium salt of caproic acid, lauric acid, palmitic acid, stearic acid, or fatty acid derived coconut oil or tallow oil.

8. The powder detergent composition according to claim 1, further comprising one or more component selected from the following surface active agents, antifoaming agents, chelating agents, alkali agents, fillers, enzymes, dispersing agents, bleaching agents, dyes, perfumes, colorants and preservatives.

9. The detergent composition according to claim 8, wherein said mixture is present in an amount from 3–20 percent by weight based on the total weight of the detergent composition.

10. The powder detergent composition according to claim 1 adapted for use as a laundry detergent.

11. A method for producing a powder detergent composition according to claim 5 comprising a mixture of an ethoxylated glycerine compound having formula (I)

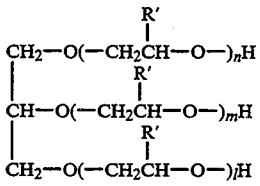

(I)

wherein R′ is H or $CH_3$, and each of n, m and l independently is an integer from 0 to 20 and the sum of m, n and l is from 2–60; and a fatty acid alkali metal salt having formula (II)

R—COOM (II)

wherein R is an alkyl or alkenyl group having 7–21 carbon atoms, and M is an alkali metal, wherein the weight ratio of said ethoxylated glycerine to the fatty acid alkali metal salt is from 1:5–5:1, comprising the steps of adding the ethoxylated glycerine compound and the fatty acid alkali metal salt to a detergent slurry; mixing said slurry, and spray-drying said slurry.

12. A method for producing a powder detergent composition according to claim 5 comprising a mixture of an ethoxylated glycerine compound having formula (I)

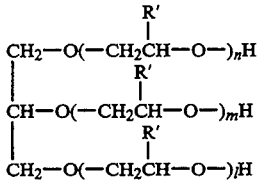

(I)

wherein R′ is H or $CH_3$, and each of n, m and l independently is an integer from 0 to 20 and the sum of m, n and l is from 2–60; and a fatty acid alkali metal salt having formula (II)

$$R—COOM \quad (II)$$

wherein R is an alkyl or alkenyl group having 7–21 carbon atoms, and M is an alkali metal, wherein the weight ratio of said ethoxylated glycerine to the fatty acid alkali metal salt is from 1:5–5:1, comprising the steps of combining said ethoxylated glycerine and said fatty acid alkali metal salt to obtain a mixture, and adding said obtained mixture to a powder detergent mixture.

* * * * *